US006488478B2

(12) United States Patent
Ono et al.

(10) Patent No.: US 6,488,478 B2
(45) Date of Patent: Dec. 3, 2002

(54) HIGH PRESSURE FUEL PUMP

(75) Inventors: Yoshinobu Ono, Hitachinaka (JP); Yukio Takahashi, Hitachinaka (JP); Hideki Machimura, Hitachinaka (JP); Minoru Hashida, Hitachinaka (JP); Masayoshi Kotaki, Hitachinaka (JP); Takefumi Yamamura, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/141,119

(22) Filed: May 9, 2002

(65) Prior Publication Data

US 2002/0127119 A1 Sep. 12, 2002

Related U.S. Application Data

(62) Division of application No. 09/526,742, filed on Mar. 16, 2000.

(30) Foreign Application Priority Data

Jun. 21, 1999 (JP) ..... 11-173695

(51) Int. Cl.[7] ..... F04B 27/08
(52) U.S. Cl. ..... 417/269
(58) Field of Search ..... 417/269, 270; 92/71

(56) References Cited

U.S. PATENT DOCUMENTS

| | | | | | |
|---|---|---|---|---|---|
| 3,209,701 | A | | 10/1965 | Phinney | |
| 3,663,122 | A | * | 5/1972 | Kitchen | 417/269 |
| 3,958,901 | A | * | 5/1976 | Drevet | 417/269 |
| 4,046,494 | A | * | 9/1977 | Salzgeber et al. | 417/253 |
| 4,197,058 | A | * | 4/1980 | Simko | 417/270 |
| 4,531,494 | A | * | 7/1985 | Bailey et al. | 123/450 |
| 4,838,765 | A | * | 6/1989 | Wusthof et al. | 417/203 |
| 5,370,505 | A | * | 12/1994 | Takenaka et al. | 417/269 |
| 5,647,266 | A | * | 7/1997 | Class | 92/71 |
| 5,700,135 | A | * | 12/1997 | Inokuchi et al. | 417/269 |
| 6,074,175 | A | * | 6/2000 | Hoshi et al. | 417/269 |
| 6,142,060 | A | * | 11/2000 | Salto et al. | 92/71 |
| 6,179,574 | B1 | * | 1/2001 | Yie | 417/269 |
| 6,368,071 | B1 | * | 4/2002 | Hashida et al. | 417/269 |

FOREIGN PATENT DOCUMENTS

| | | |
|---|---|---|
| DE | 19708917 | 10/1997 |
| DE | 19827926 | 1/1999 |
| DE | 19643134 | 4/2001 |
| EP | 0018265 | 10/1980 |
| JP | 09-236080 | 9/1997 |
| JP | 09-250447 | 9/1997 |

OTHER PUBLICATIONS

Copy of Search Report.

* cited by examiner

*Primary Examiner*—Teresa Walberg
*Assistant Examiner*—Leonid Fastovsky
(74) *Attorney, Agent, or Firm*—Crowell & Moring LLP

(57) ABSTRACT

An axial plunger pump which does not need bellows by restricting fuel to a cylinder bore configuring a pump portion and by lubricating the other portion with oil. The high pressure fuel pump includes a plunger reciprocating according to a shaking movement of a swash plate, a cylinder block forming a pump chamber together with the plunger, and a sealing member provided between the plunger and a cylinder bore for sealing oil leaked from the pump chamber to a chamber surrounding the pump chamber, wherein oil in the oil chamber is supplied from the outside of the high pressure fuel pump.

1 Claim, 5 Drawing Sheets

(a) INTAKE STROKE (b) DISCHARGE STROKE

HIGH PRESSURE FUEL PUMP

This application is a division of application Ser. No. 09/526,742, filed Mar. 16, 2000.

BACKGROUND OF THE INVENTION

The present invention relates to a fuel pump for supplying fuel to an internal combustion engine, particularly relates to a high pressure fuel pump used in a fuel injection system of so-called in-cylinder direct injection type of an internal combustion engine, the system directly injects fuel into a fuel chamber through a fuel injection valve attached to the fuel chamber.

DESCRIPTION OF THE PRIOR ART

A type of system which directly injects fuel to a combustion chamber of an internal combustion engine requires a high pressure fuel pump for increasing a pressure of fuel to be supplied to a fuel injection valve up to the pressure of 3 MPa or higher.

Such a high pressure pump has been known from JP-A-9-236080 as an axial plunger pump. Conventionally, such a high pressure pump is configured so as to part a driving mechanism part lubricated with oil from a pump chamber compressing and discharging fuel by metal bellows.

Another conventional high pressure fuel pump is described in JP-A-9-250447. The pump is configured so as to circulate fuel up to the sliding part of the driving mechanism part, in the other word, lubricate the driving mechanism part with fuel. In this prior art, the sliding part is lubricated with fuel.

Such types of conventional high pressure pump have problems as follows;

(1) As for the former pump, the pomp has a large sized shape by using the metal bellows. In addition, the pump needs a sealing part at a mounting part of the bellows. Because of these points, the pump has a problem that it is difficult to miniaturize the pump.

(2) As for the latter pump, the bellows is not necessary. However, a lubricating condition of the driving mechanism part is hard since the sliding part is lubricated with fuel of a low viscosity.

The object of the present invention is to provide an axial plunger pump which does not need bellows and lubricates the driving mechanism part sufficiently.

Another object of the present invention is to allow the pump to use a rolling bearing for the driving mechanism.

SUMMARY OF THE INVENTION

In order to solve the problems, the present invention provides a high pressure fuel pump comprising a cup-shaped body; a cylinder block engaged with the cup-shaped body so as to close the opening side of the cup-shaped body; a rotation shaft supported at the bottom of the cup-shaped body and rotated by a driving source; a swash plate disposed in a driving mechanism chamber inside the cup-shaped body, which converts a rotating movement to a shaking movement; a plunger reciprocated in a cylinder bore formed in the cylinder block according to the shaking movement of the swash plate; a sealing element provided between the inside wall of the cylinder bore and the plunger; and an oil supply mechanism which supplies oil to the driving mechanism chamber.

According to further aspect of the present invention, it provides a high pressure fuel pump comprising: a cup-shaped body; a cylinder block engaged with the cup-shaped body so as to close the opening side of the cup-shaped body; a rotation shaft supported at the bottom of the cup-shaped body and rotated by a driving source; a swash plate disposed in a driving mechanism chamber inside the cup-shaped body, which converts a rotating movement to a shaking movement; a plunger reciprocated in a cylinder bore formed in the cylinder block according to the shaking movement of the swash plate; a sealing element provided between the inside wall of the cylinder bore and the plunger; an oil supply mechanism which supplies oil to the driving mechanism chamber; a low pressure side fuel passage formed in the cylinder block; and a low pressure fuel introducing passage formed in the plunger, which connects the low pressure side fuel passage with a pump chamber formed in the cylinder bore, the pump chamber varying its capacity according to the plunger reciprocating in the cylinder bore.

Moreover, the high pressure fuel pump may comprise a valve mechanism disposed between the low pressure side fuel passage and the pump chamber, which shut off the connection between the low pressure side fuel passage and the pump chamber when a pressure of the pump chamber is more than a defined pressure so that the sealing element is adopted to be acted by a pressure of the upper stream of the valve mechanism.

According to another aspect of the present invention, it provides 9 a high pressure fuel pump comprising: a shaft for transmitting a driving force from the outside; a cam converting a rotating movement of the shaft to a reciprocating movement; a plunger reciprocated by the cam; a cylinder bore formed in a cylinder block; a pump chamber formed by putting the plunger into the cylinder bore; a sealing element sealing a apace between the cylinder bore and the plunger; and an oil supply mechanism which supplies oil to the cam.

DESCRIPTION OF THE PREFERRED EMBODIMENTS

Figure 1:
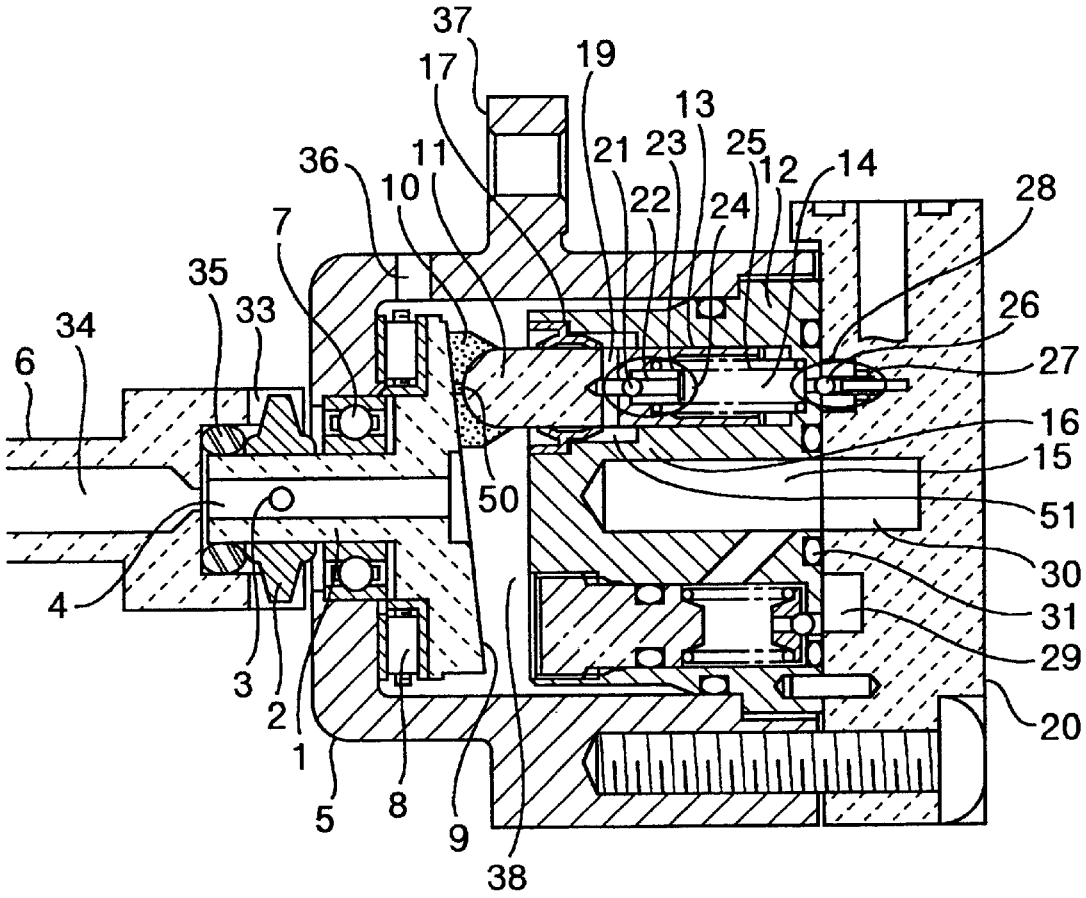
FIG. 1 shows a longitudinal section of a pump of a first embodiment according to the present invention.
Figure 2:
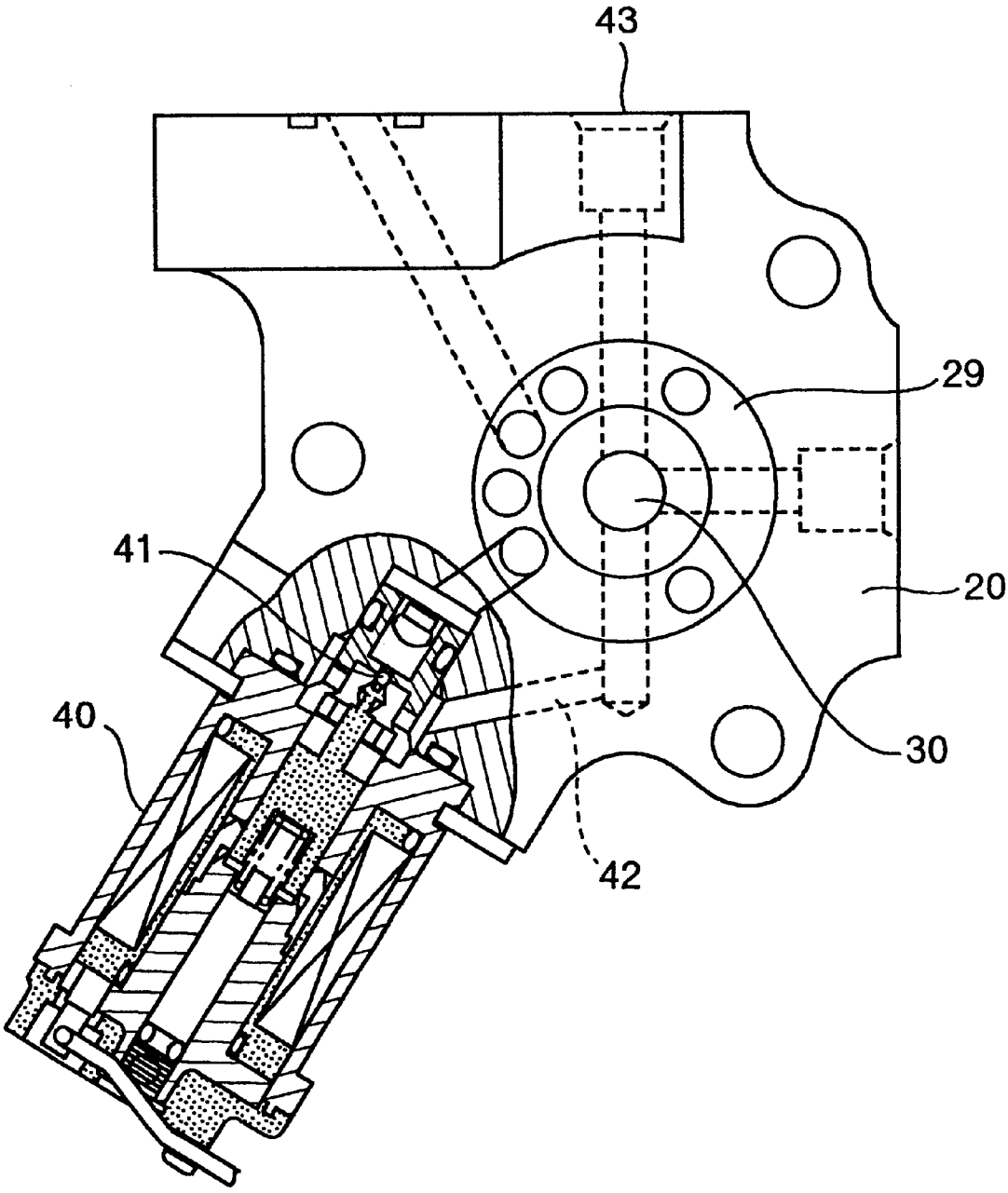
FIG. 2 shows a structure of passages in a rear body of the first embodiment.

A first embodiment is shown in FIGS. 1–4.

A coupling 2 for transmitting a driving force transmitted by a cam shaft of an engine connects with a shaft 1 through a pin 3. The shaft 1 is integrated with a swash plate 9 which extends in the radial direction and has an end surface forming a slope. A slipper 10 contacts with the swash plate 9. The slipper 10 is provided with a taper at its outer circumference portion in the swash plate 9 side for helping formation of an oil layer between the swash plate 9 and the slipper 10. A hole 50 opening in the center of the slipper 10 connects the swash plate 9 side with the other side of the slipper 10 and forms a space for holding oil. The swash plate 9 takes a role to supply oil scraped by the swash plate 9 from the swash plate 9 side to the other side of the slipper 10. The slipper 10 has a spherical shape in the other side thereof and is supported by a sphere formed on a plunger 11 which slides in a cylinder bore 13. The rotating swash plate 9 causes a shaking movement which is converted to a reciprocating movement of the plunger 11.

In the pump having the above described structure, suction and discharge of fuel are performed as follows.

A plurality of pump chambers 14 are formed in a cylinder block 12 by the cylinder bores 13 and the plungers 11. An intake space 15 connected to respective plungers 11 is provided in the center of the cylinder block 12 to supply fuel to the pump chamber 14. In order to introduce fuel to the intake space 15, a fuel piping from the outside of the pump is connected to a rear body 20 so as to connect with the intake space 15 provided in the cylinder block 12 thorough an intake passage 43 of the rear body 20 and an intake chamber 30 in the center of the rear body 20.

In the plunger 11, an intake valve 24 (a check valve) is formed by a ball 21, a spring 22, and a stopper 23 supporting the spring 22. A plunger spring 25 is installed to press always the plunger 11 toward the swash plate 9 side in order to allow the slipper 10 and the plunger 11 to follow the swash plate 9.

A connecting passage A 16 toward an intake valve 24 in the plunger 11 is formed as the connecting passage between a spot facing 51 made in the cylinder bore and the intake space 15. The spot facing 51 has a diameter larger than that of the cylinder bore 13 and is formed up to a depth allowing the spot facing 51 to connect with an introducing hole 19 for always introducing fuel to the inside of the plunger 11 even if the pump chamber 14 becomes fully smaller (when the plunger position is at a top dead center).

Figure 3:
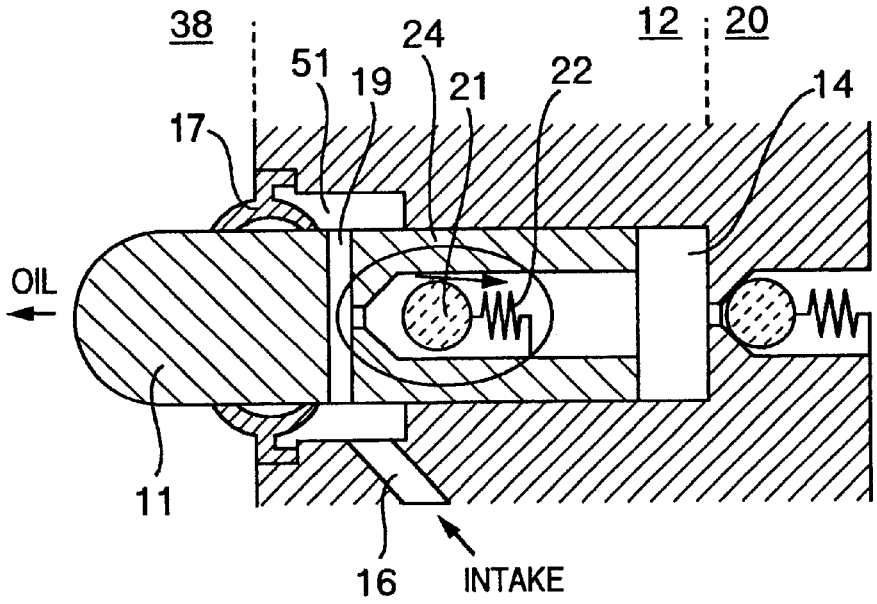
FIG. 3 is an explanation figure of strokes.
Figure 3:
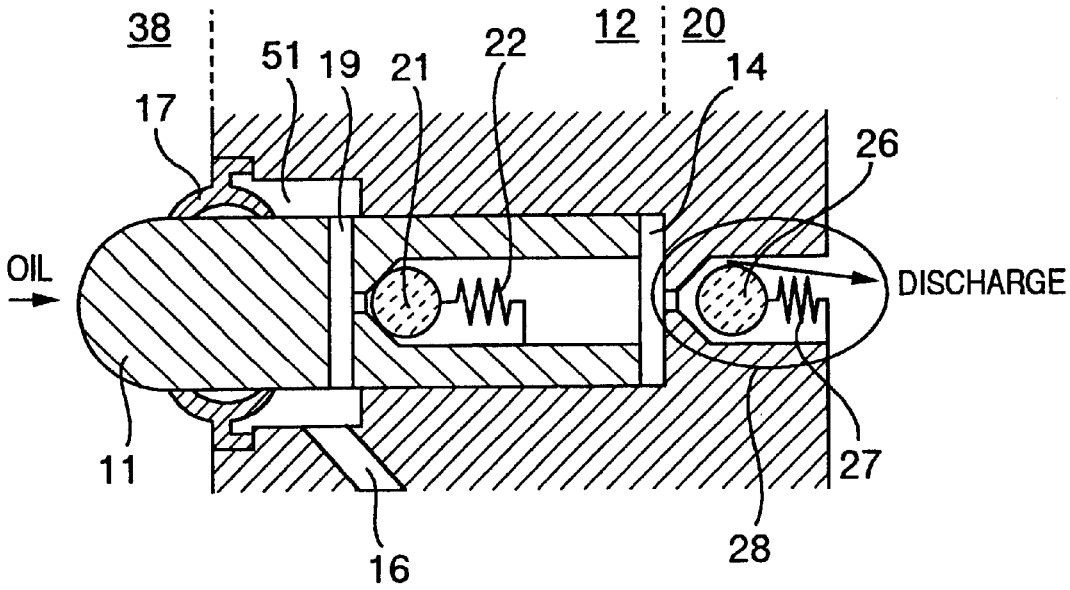
Figure 4:
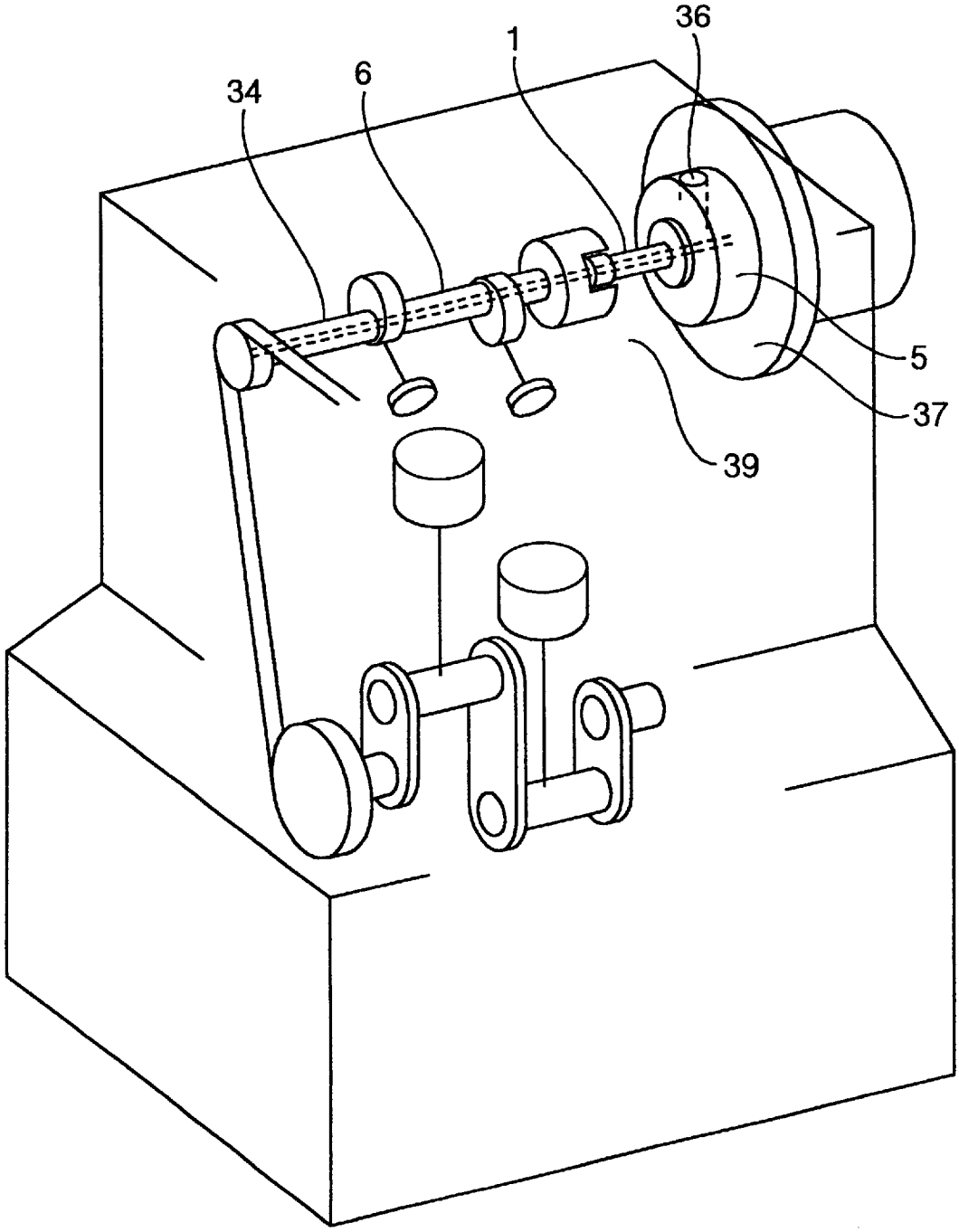
FIG. 4 shows an engine oil passage of the first embodiment.

FIG. 3 is an illustrated figure of strokes and an enlarged figure of the plunger 11. In an intake stroke (a stroke in which the plunger 11 moving in a direction to increase a space of the pump chamber 14), the intake valve 24 installed in the plunger 11 is opened to introduce fuel into the pump chamber 14 when a pressure inside the pump chamber 14 installed in the plunger 11 reduces up to a pressure below a defined pressure. In this structure, when a discharge stroke (a stroke in which the plunger 11 moving in a direction to decrease the space of the pump chamber 14) has been started, fuel introduced into the pump chamber 14 during the intake stroke is sent out from the pump chamber 14 to a discharge chamber 29 installed in the rear body 20 by opening a discharge valve 28 comprising a ball 26 and a spring 27 at the time that a pressure of the pump chamber 14 comes to a defined pressure, as well as the intake valve 24. An intake chamber 30 and the discharge chamber 29 which are installed in the rear body 20 are partitioned with an O-ring 31, and the intake chamber 30 is installed nearer the center than the discharge chamber 29 so as to make the structure of the passage of the pump itself compact.

In the description stated before, a pressure of the discharge chamber 29 can be regulated to an optimal pressure with a pressure regulating valve 40 (a pressure regulator: hereafter stated as P/Reg) installed in a passage connected to the discharge chamber 29. The purpose for regulating the discharge pressure is to regulate an additional pressure applied to an injector (not illustrated) installed in the downstream of the discharge side. A high pressure fuel passed from a high pressure chamber of the rear body 20 to P/Reg 40 is passed through a ball valve 41 installed in P/Reg 40 and passed through connecting passage B 42 installed in the rear body 20 to return to the intake chamber 30. An intake passage 43, the intake chamber 30, the intake space 15, and the connecting passage A 16 form a passage for supplying fuel from a fuel source to respective cylinders.

As described above, a pressure inside the pump chamber 14 also changes from a intake pressure (generally, from 0.2 MPa to 0.5 MPa) to a pressure of the high pressure chamber (generally, from 3 MPa to 20 Mpa). A load generated by a fuel pressure of the pump chamber is transmitted to the swash plate 9 of the shaft 1 via the plunger 14 and the slipper 10. This means that the resultant of force loads of a plurality of the plungers 11 acts on the swash plate 9. The resultant of forces acts as a radial load according to a load in the direction of the shaft and an angle of the swash plate. The present invention has the structure that the shaft 1 is engaged with a radial bearing 7 and the thrust bearing 8 to support its load by the body 5 for supporting these loads and achieving a smoothed rotation.

Parts (slipper 10/swash plate surface 9, slipper 10/plunger sphere, and bearing parts) supporting these loads are the parts supporting a relative speed and loads by rotation, and sliding wear can be reduced by oil lubrication. For this purpose, the structure is required to trap oil by a swash plate chamber 38 formed between the body 5 and the cylinder 12.

In this embodiment, a shaft seal A 17 for sealing fuel and oil during reciprocating movement of the plunger 11 is installed in the cylinder 12. This shaft seal A 17 seals a gap between the plunger 11 and the cylinder bore 13. The shaft seal A 17 seals fuel and oil. The present embodiment has a structure in which a pressure acting on the shaft seal A 17 is always the intake pressure of a low pressure to allow no application of a pressure of the high pressure chamber against the shaft seal A 17 because an intake passage 43 exists between the shaft seal A 17 and the pump chamber 14. By this reason, durability and reliability of the shaft seal 17 increase.

The following is an explanation of a circulation passage and a circulation method of oil. The structure of the example is that a shaft 1 through which a shaft seal B 35 and a coupling 2 are penetrated is engaged with a coupling engaging part 33 of the engine cam 6 which is provided with an oil passage 34 in its shaft center, so that oil is introduced from an engine through a connecting passage C 4 to the swash plate chamber 38 installed in the center of the shaft 1. The shaft seal B 35 seals oil incompletely in a degree to allow necessary minimum flow from the engine side to a swash plate chamber 38. By this, an eccentric load on the driving shaft via the shaft seal B 35, which is caused by a distance of centers of the shaft 1 and the engine cam 6, can be suppressed in a maximum degree, so that durability of the radial bearing 7 is improved. In addition, since oil flowing into the swash plate chamber 38 is controlled as the necessarily minimized flow, rise of temperature of the swash plate chamber 38 is suppressed and oil diluted with fuel leaked to the swash plate chamber 38 from the shaft seal A 17 is replaced. Further, since the purpose is accomplished by introducing oil from the center of the shaft 1 without installation of a new oil passage in the engine side, fitness to the engine and miniaturization of the engine are accomplished.

In this embodiment, oil is introduced from a connecting passage C 4 installed in the center of the shaft. Notwithstanding, the place is not restrictive if the passage for introducing oil is installed to connect the source of an oil pressure of the engine to the swash plate chamber 38 of the pump.

The following is a description of a passage to return oil, which is supplied from the engine to the swash plate chamber 38, to the engine. This passage comprises a return passage 36 from the swash plate chamber 38 to the engine cam chamber 39. The return passage 36 is installed in a coupling 2 side of the surface of a flange 37 installed in the body 5 of the pump to be attached to the engine. By this, oil in the swash plate chamber 38 can be returned to the engine without installing a special passage in the engine side. The return passage 36 is installed in a level higher than a sliding surface between the swash plate 9 and the slipper 10. By this, if vapor occurs, the vapor is discharged from the return passage 36 to the engine cam chamber 39 to lubricate always the sliding surface with oil. The diameter of the return passage 36 is set larger than that of the connecting passage C 4 for introducing oil. By this, the quantity of oil flowing out from the swash plate chamber 38 does not become lower than the quantity of oil flowing in, and the pressure of the inside of the swash plate chamber 38 does not rise, so that reliability of the shaft seal 17 is increased.

The pressure of the inside of the swash plate chamber 38 does not rise to become always lower than an intake pressure of fuel. By this, leak of oil to the fuel side can be prevented. As well, the plunger 11 received always a force toward the swash plate so as to reduce a load on the plunger spring 25. The relations between pressures of respective parts are thus expressed by the following equation.

Intake fuel pressure≧oil chamber pressure; and oil pressure supplied from engine≧oil chamber pressure.

Figure 5:
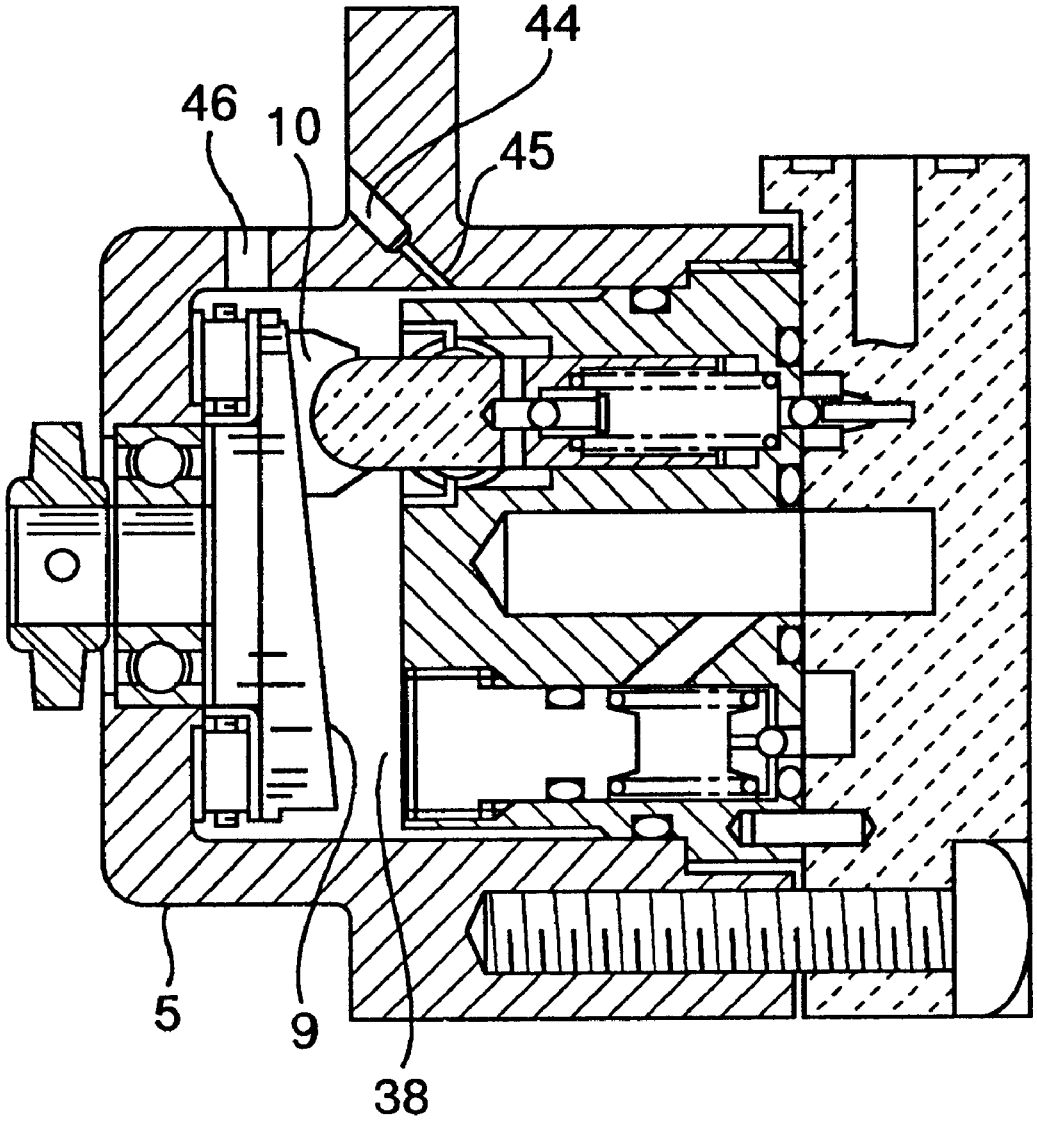
FIG. 5 shows an oil passage of a second embodiment.

FIG. 5 shows a second embodiment in which an oil introducing passage 44 is installed to introduce oil positively from the engine. The oil introducing passage 44 is installed in the body 5 and a constriction 45 is installed in the middle thereof. The pressure of oil-introducing side has been increased than that of the swash plate chamber 38. Installing the constriction 45 suppresses an excessive oil flow with a high temperature to prevent heating of fuel. Besides, a return passage 46 is installed in the body 5 to return oil from the swash plate chamber 38 to the engine cam chamber 39. The return passage 46 is installed in a level higher than a sliding surface between the swash plate 9 and the slipper 10. By this, if vapor occurs, the vapor is discharged from the return passage 46 to the engine cam chamber 39 to always lubricate the sliding surface-with oil to increase reliability.

According to the features described above, the main body of the pump can be miniaturized since the pump requires no member such as bellows for insulating an oil circulating part from a fuel circulating part, and no sealing member installed at a part to which bellows is attached. Further, because the sliding part is lubricated with oil, a rolling bearing can be used as a bearing. Thus, a friction resistance is reduced, so that a driving torque can be decreased.

Furthermore, because an existing oil passage of an engine can be used since an oil-introducing passage is installed on an axis of a cam shaft, no exclusive passage is required. Therefore, fitness to the engine is improved and also the miniaturization of the pump can be accomplished.

What is claimed is:

1. A high pressure fuel pump, comprising:

a pump body;

a cylinder bore formed in the pump body;

a plunger slidably inserted in the cylinder bore so as to form a compression chamber for compressing gasoline; and a sealing element installed between the inside wall of the cylinder bore the periphery of the plunger for sealing the compression chamber air-tightly;

a low pressure fuel passage bored in he plunger at a portion between the sealing element and the compression chamber, core connecting the compression chamber with a low pressure fuel chamber formed in the pump body; and an intake valve mechanism installed in the low pressure fuel passage, wherein the plunger is arranged to reciprocate in the cylinder bore while the sealing element divides the compression chamber from and an oil chamber formed in the pump body.

* * * * *